US009147958B2

(12) United States Patent
Kuroda

(10) Patent No.: US 9,147,958 B2
(45) Date of Patent: Sep. 29, 2015

(54) CONNECTOR

(71) Applicant: Sumitomo Wiring Systems, Ltd., Yokkaichi, Mie (JP)

(72) Inventor: Shinya Kuroda, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 19 days.

(21) Appl. No.: 14/050,462

(22) Filed: Oct. 10, 2013

(65) Prior Publication Data

US 2014/0120762 A1 May 1, 2014

(30) Foreign Application Priority Data

Oct. 30, 2012 (JP) ..... 2012-239172

(51) Int. Cl.
*H01R 13/436* (2006.01)
*H01R 13/422* (2006.01)

(52) U.S. Cl.
CPC ..... *H01R 13/4362* (2013.01); *H01R 13/4223* (2013.01)

(58) Field of Classification Search
CPC ..... H01R 13/4362; H01R 13/4223; H01R 13/4365; H01R 13/6272; H01R 13/641; H01R 13/52
USPC ..... 439/752, 595, 345, 352, 489, 638, 587; 29/428
See application file for complete search history.

(56) References Cited

U.S. PATENT DOCUMENTS 5,658,159 A * 8/1997 Gardner et al. ..... 439/294
6,582,242 B2 * 6/2003 Murakami et al. ..... 439/271
8,038,455 B1 * 10/2011 Moraes et al. ..... 439/140

* cited by examiner

*Primary Examiner* — James Harvey
*Assistant Examiner* — Oscar C Jimenez
(74) *Attorney, Agent, or Firm* — Gerald E. Hespos; Michael J. Porco; Matthew T. Hespos

(57) ABSTRACT

A connector has a first housing (10), a second housing (40) including a base (41) arranged behind the first housing (10), and a retainer (60) between the base (41) and the first housing (10) and movable between partial and full locking positions along facing surfaces of the base and the first housing. The retainer (60) includes operating portions (62) projecting forward so that tips thereof are exposed at a front of the first housing (10). The first housing (10) has locking receiving portions (18, 19) arranged side by side in a moving direction of the retainer (60), and the operating portion (62) is formed with a lock (66) for resiliently locking the locking receiving portions (18, 19) when the retainer (60). An engaging direction of the lock (66) and the locking receiving portions (18, 19) intersects assembling directions of the retainer (60) and the first housing (10).

18 Claims, 12 Drawing Sheets

CONNECTOR

BACKGROUND

1. Field of the Invention

The invention relates to a connector.

2. Description of the Related Art

Japanese Unexamined Patent Publication No. 2001-143807 discloses a connector with a block-shaped housing main body that has a cavity into which a terminal fitting is insertable from behind. A retainer is mounted into the housing main body and is movable between a partial locking position and a full locking position. A fitting tube portion surrounds the housing main body. A receptacle of a mating housing fits into a clearance between the housing main body and the fitting tube. The retainer includes a retaining portion at a position corresponding to the cavity. The retaining portion is retracted from the cavity at the partial locking position to permit insertion of the terminal fitting into the cavity. The retaining portion is inserted in the cavity at the full locking position and is arranged to lock the properly inserted terminal fitting in the cavity from behind. Thus, the retaining portion holds and retains the terminal fitting in the housing main body when the retainer is at the full locking position.

The fitting tube surrounds the housing main body. Thus, a through hole for the retainer has to be formed on the fitting tube to mount and move the retainer laterally in the housing main body. Water may enter the inside through the insertion hole and may impair watertightness.

In view of this, a housing main body may be divided into front and rear housing parts 1 and 2 and a main part 4 of a retainer 3 is located between the housing parts 1, 2 as shown in FIG. 12. Thus, the retainer 3 can be mounted into a fitting tube from front without forming a through hole.

Operating portions 5 may project forward from the main part 4 of the retainer 3 and tip parts of the operating portions 5 may be exposed at a front of the front housing part 2. Thus, the retainer 3 can be moved by bringing a jig or the like into contact with the operating portions 5 from the front. A protrusion 6 could be provided on the rear surface of the main part 4 of the retainer 3, and two recesses 7 could be provided on the front surface of the rear housing part 1. The retainer 3 then could be held at a partial locking position and a full locking position by the engagement of the recess 7 and the protrusion 6, as shown in FIG. 13. However, a depth direction of the recesses 7 and a projecting direction of the protrusion 6 coincide with an assembling direction of the main part 4 with the housing parts 1, 2. Thus, an engagement margin between the recess 7 and the protrusion 6 may be reduced due to a clearance caused by an assembling error between the housing parts 1, 2 and the main part 4. As a result, a specified engagement margin cannot be obtained and the retainer 3 may lack holding reliability.

The invention was completed in view of the above situation and aims to improve the holding reliability of a retainer.

SUMMARY OF THE INVENTION

The invention relates to a connector with first and second housings and at least one terminal fitting that is insertable into the first housing. The second housing has a base to be arranged behind the first housing. The connector also has a retainer arranged between the base and the first housing. The retainer is movable between first and second positions substantially along facing surfaces of the base and the first housing. The retainer is capable of locking and retaining the terminal fitting properly inserted into the first housing as the retainer reaches the second position. At least one operating portion projects forward on the retainer and has a portion exposed at a front of the first housing. An operating force can be applied to the operating portion from the front of the first housing to move the retainer. The first housing has at least one lock receiving portion and the operating portion has at least one lock. The lock resiliently locks the lock receiving portion to keep the retainer at the first position and/or the second position. An engaging direction of the lock and the locking receiving portion intersects the forward and backward assembling directions of the retainer and the first housing. Thus, an engagement margin between the lock and the lock receiving portions is not reduced even if there is an assembling error in forward and backward directions between the first housing and the retainer. As a result, the retainer is held reliably on the first housing.

The formation of the lock on the operating portion of the retainer efficiently enables an operating force to be applied to the operating portion for releasing a locked state of the lock receiving portion by the lock. Thus, releasing operability is good.

The first housing preferably has at least two lock receiving portions arranged substantially side by side in a moving direction of the retainer, and the lock resiliently locks the lock receiving portion to keep the retainer at the first or second position.

The first housing may have a first hole to receive the operating portion at the first position and a second hole to receive the operating portion at the second position. The first and second locking holes may communicate in the moving direction of the retainer.

A protrusion of a mating housing preferably is inserted into the first hole to permit a connection operation to the mating housing when the operating portion is located properly in the second hole. However, the protrusion interferes with a tip of the operating portion to stop the connecting operation to the mating housing when the operating portion is not located properly in the second hole. Thus, an operator can judge whether the retainer has reached the full locking position based on whether the connecting operation to the mating housing is stopped. Accordingly, the retainer will not be left without reaching the full locking position. Furthermore, the first hole is shared by the protrusion and the operating portion, thereby simplifying the configuration of the first housing.

The protrusion preferably is slidable on an inner surface of the first hole and a side surface of the operating portion in the process of connection to the mating housing when the operating portion is located properly in the second hole. Thus, the protrusion guides the connecting operation of the mating housing in addition to detecting the position of the retainer. As a result, the configuration of the mating housing is simplified as compared with the case where both functions are provided separately.

Protrusions may be arranged at each of a plurality of spaced-apart positions of the mating housing. The plural protrusions smoothly guide the connecting operation to the mating housing.

Operating portions may be arranged at each of a plurality of spaced-apart positions of the retainer. The plural operating portions smoothly guide the assembly of the first housing with the retainer from the front.

A clearance may be formed between an edge of the operating portion and a side edge of the first hole at the second position. A jig can be inserted into the clearance.

These and other objects, features and advantages of the invention will become more apparent upon reading the following detailed description of preferred embodiments and accompanying drawings.

DETAILED DESCRIPTION OF THE PREFERRED EMBODIMENTS

Figure 5:
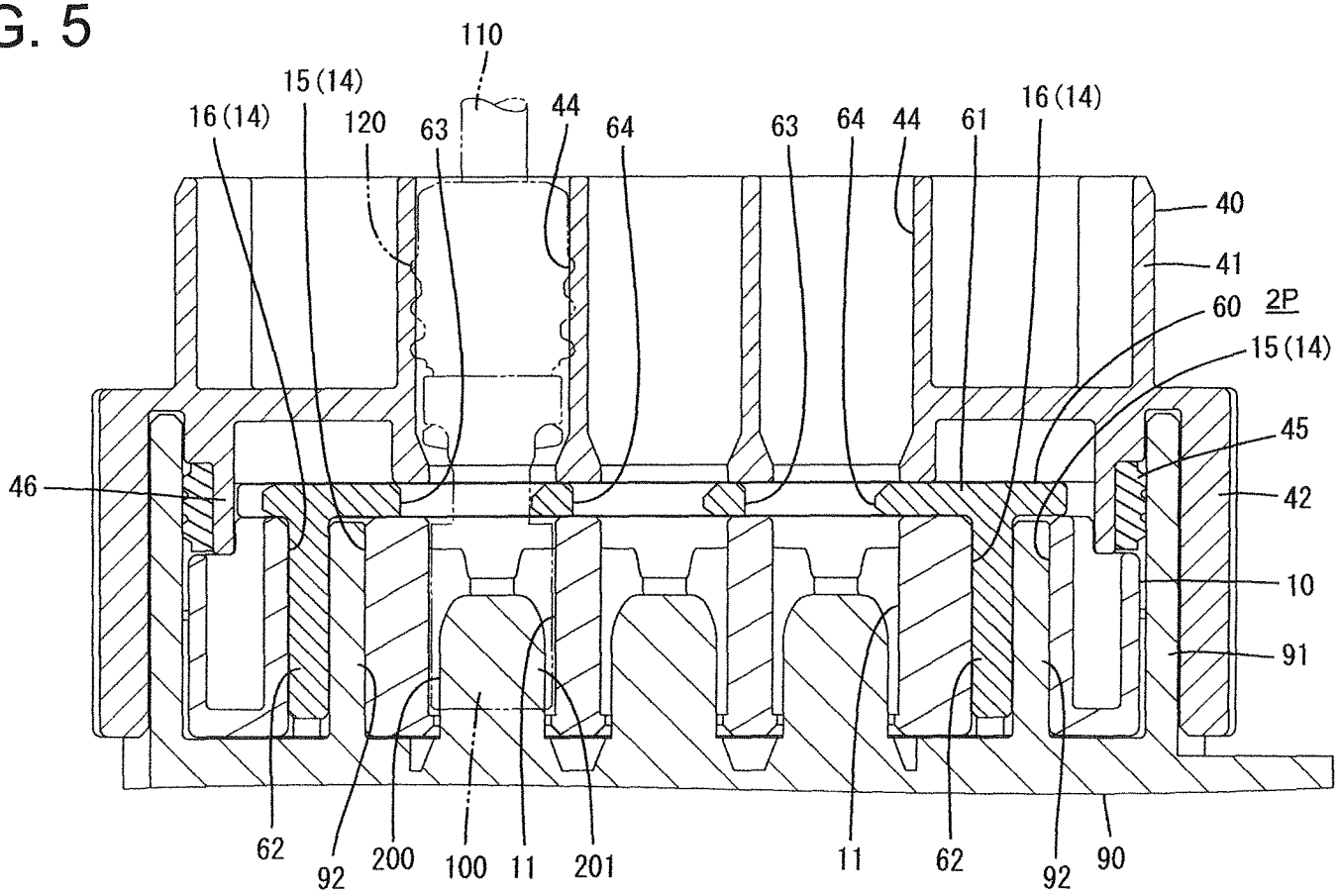
FIG. 5 is a section showing a state where the protrusions are inserted in partial locking holes and the mating housing is properly connected when the retainer is at the full locking position.

A connector in accordance with the illustrated embodiment of the invention has a first housing 10, a second housing 40 and a retainer 60, which are formed separately from one another, and are connectable to a mating housing 90, as shown in FIG. 5. In the following description, connection ends of the connector and the mating housing 90 are referred to as front ends concerning forward and backward directions.

Figure 1:
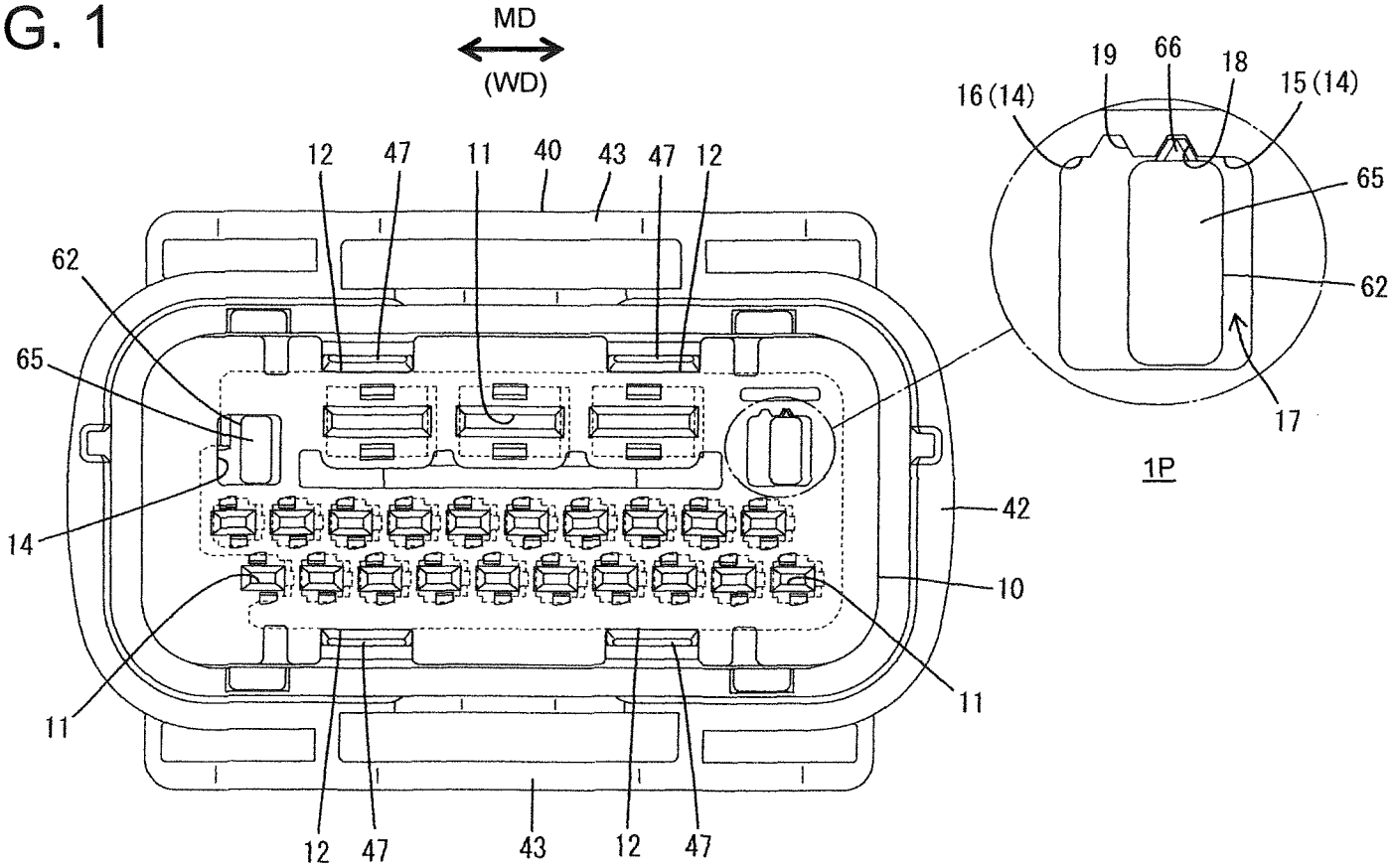
FIG. 1 is a front view showing a state where a retainer is at a partial locking position in a connector according to one embodiment of the invention.
Figure 3:
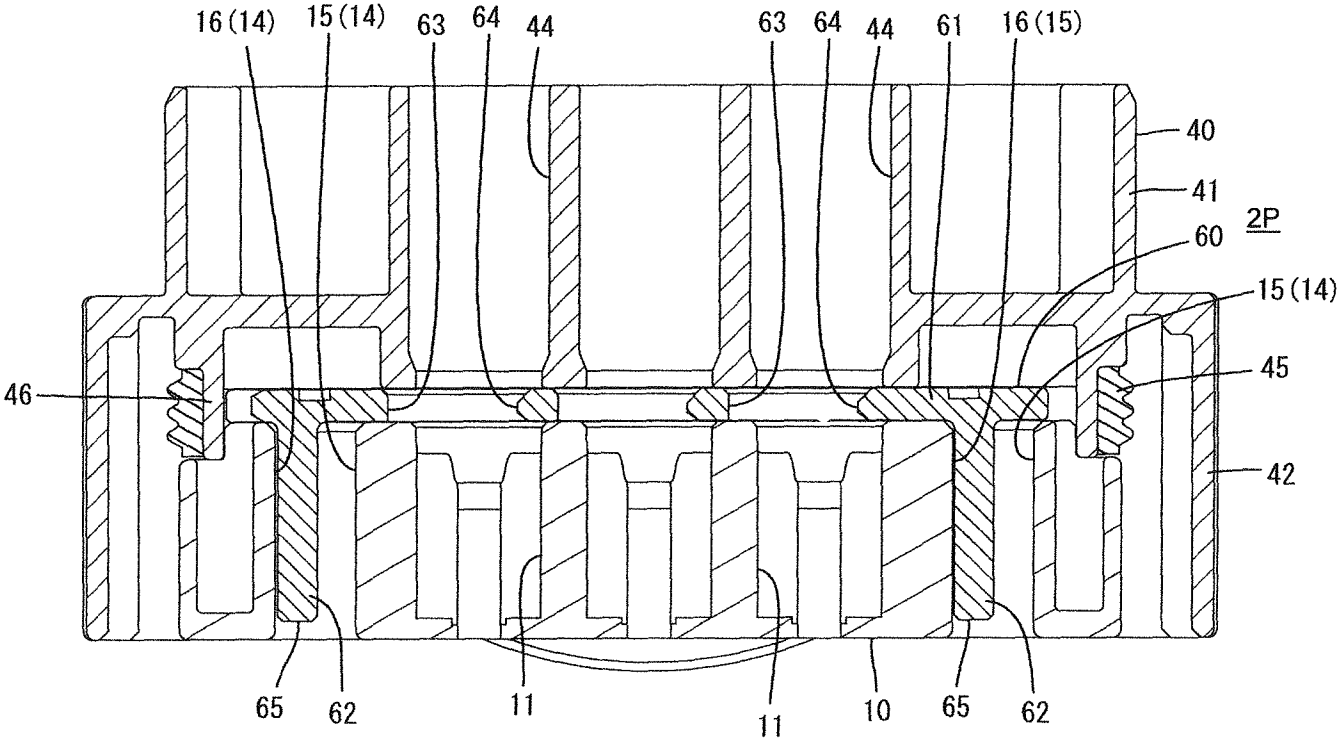
FIG. 3 is a section showing the state where the retainer is at the full locking position.
Figure 6:
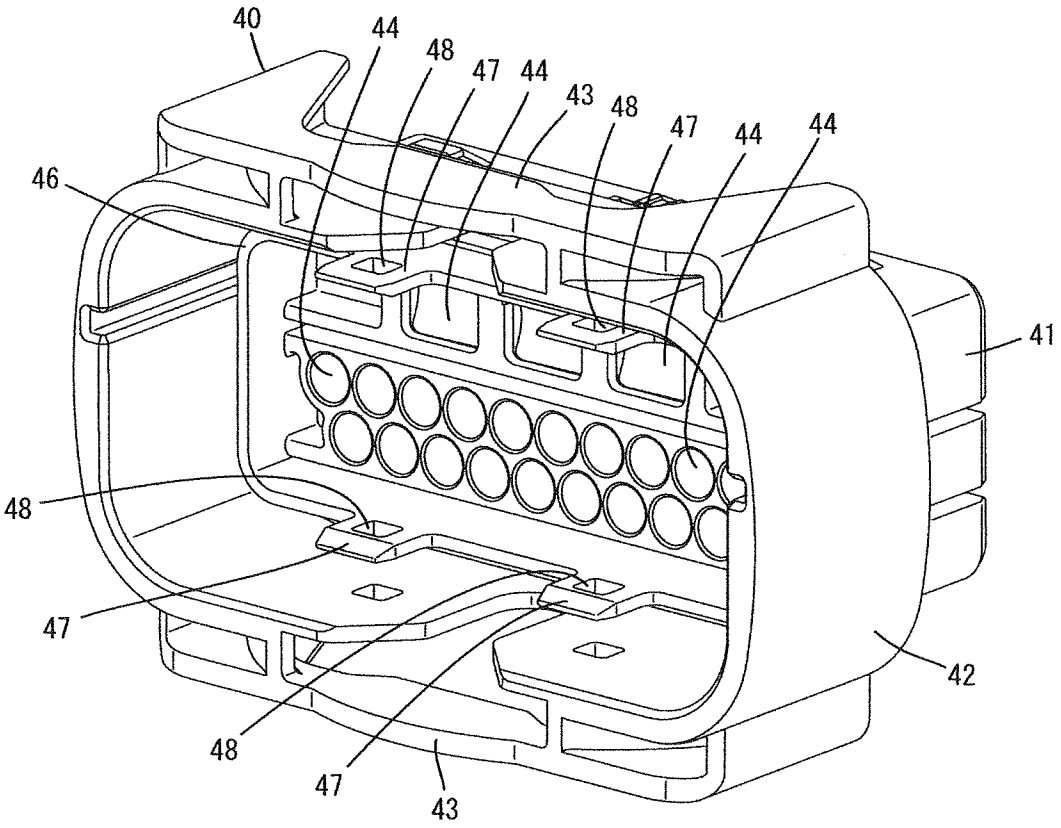
FIG. 6 is a perspective view of a second housing.

The second housing 40 is made e.g. of synthetic resin and includes a base 41 in the form of a wide rectangular block, as shown in FIGS. 3 and 6. A fitting tube 42 is widened from the outer peripheral surface of the base 41 and then projects forward. The retainer 60 and the first housing 10 are inserted successively into the fitting tube 42 from the front so that the retainer 60 is adjacent to and before the base 41 and the first housing 10 is adjacent to and before the retainer 60. The mating housing 90 can fit into the fitting tube 42. As shown in FIG. 1, lever mounting portions 43 are formed on upper and lower walls of the fitting tube 42, and an unillustrated lever is mounted thereon. The connector is to be connected to the mating housing 90 with a small operating force by a force multiplying mechanism of the lever and can be held in that connected state.

Second cavities 44 penetrate through the base 41, as shown in FIG. 3. A front end part of the outer peripheral surface of the base 41 is located inside the fitting tube 42 and a seal ring 45 is to be mounted thereon. The seal ring 45 is made of a resilient material such as rubber and can seal between the two connectors by being resiliently compressed between a receptacle 91 of the mating housing 90 and the base 41 at the time of connection, as shown in FIG. 5.

A thin tubular peripheral wall 46 projects forward on the outer peripheral edge of the front end of the base 41, as shown in FIG. 6, and the retainer 60 is accommodated inside the peripheral wall 46 at the time of assembly. Two laterally spaced plate-shaped lock pieces 47 project forward on each of the upper and lower sides of the peripheral wall 46 and a lock hole 48 is formed on a tip part of each lock piece 47. The respective lock pieces 47 resiliently engage lock projections 13 of the first housing 10 to couple and hold the first housing 10 in the second housing 40 with the retainer 60 sandwiched therebetween.

Figure 4:
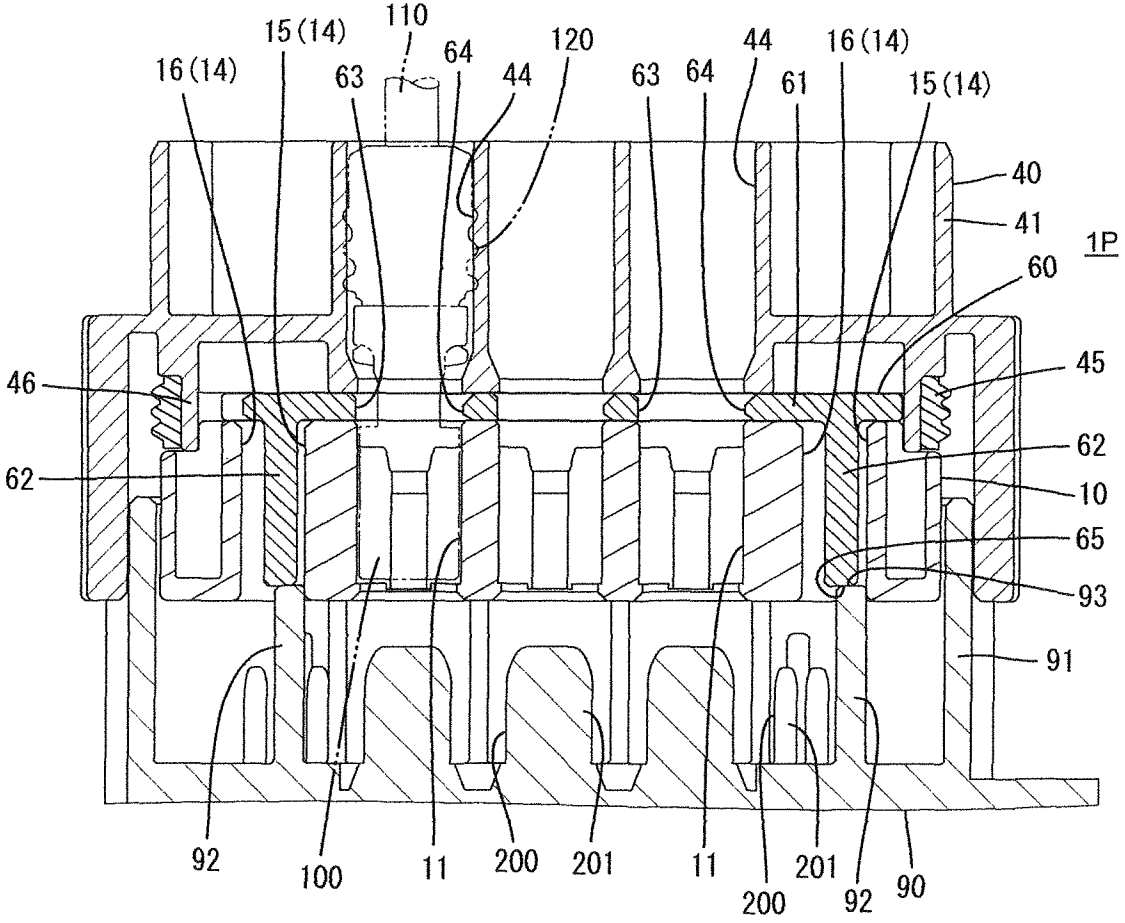
FIG. 4 is a section showing a state where protrusions interfere with operating portions to stop a connecting operation of a mating housing when the retainer is at the partial locking position.
Figure 7:
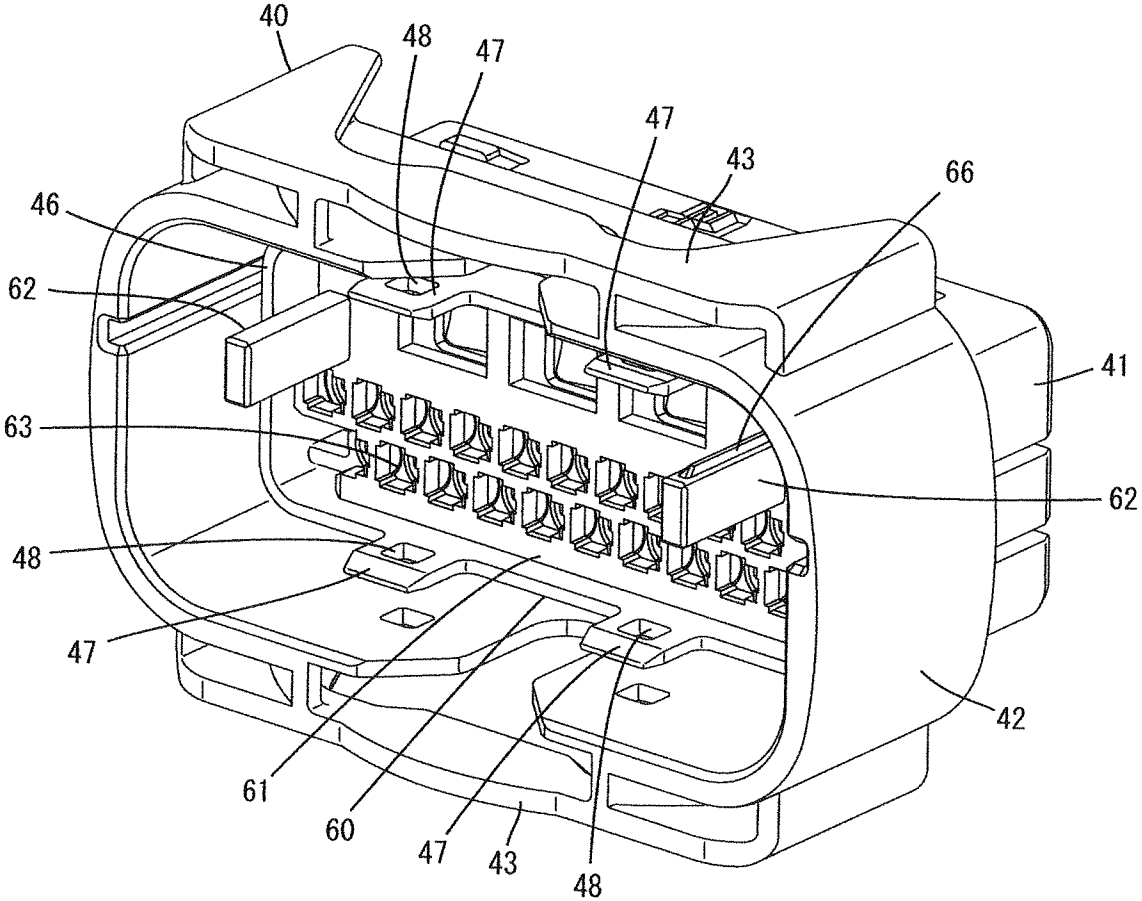
FIG. 7 is a perspective view showing a state where the retainer is assembled with the second housing.
Figure 10:
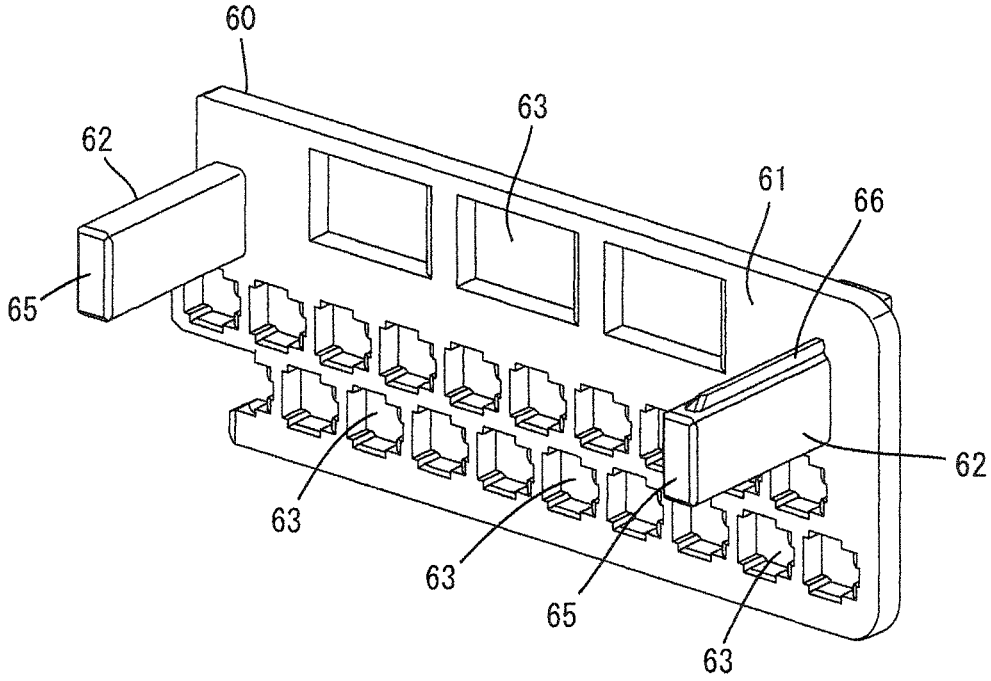
FIG. 10 is a perspective view of the retainer.
Figure 11:
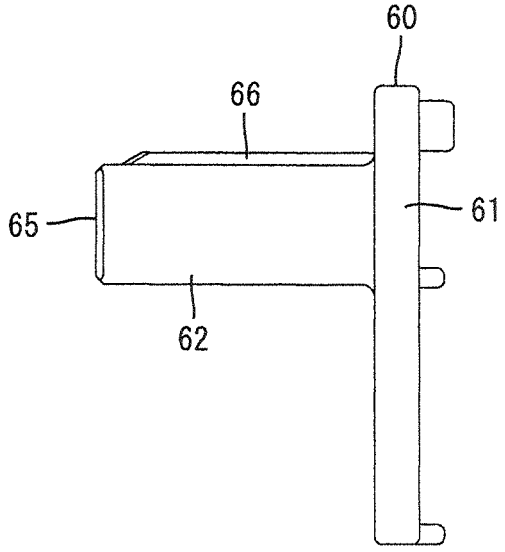
FIG. 11 is a side view of the retainer.
Figure 12:
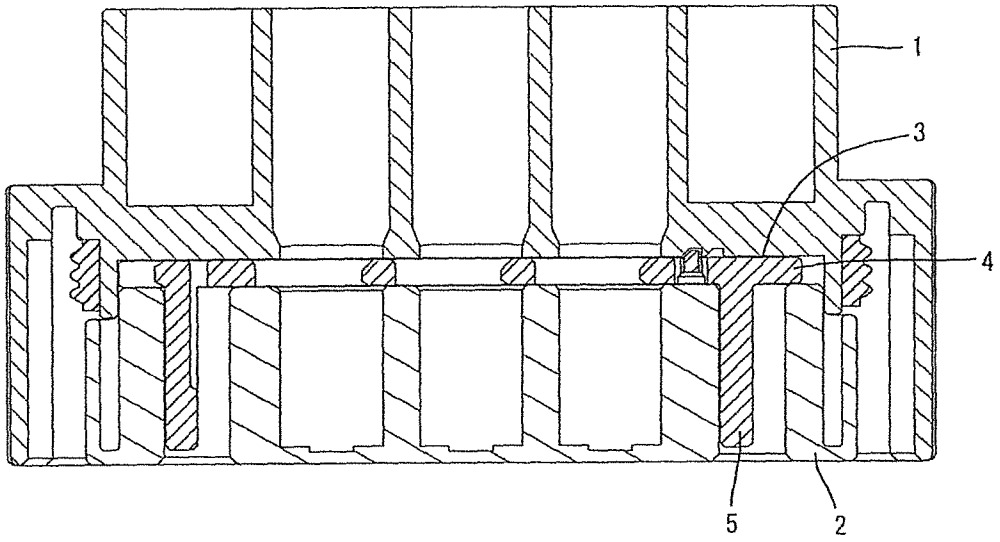
Prior Art FIG. 12
FIG. 12 is a section showing a reference example.
Figure 13A:
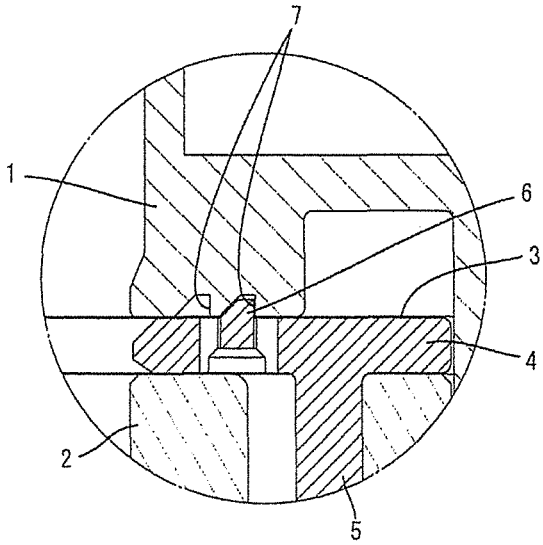
Prior Art FIG. 13(A)
FIGS. 13(A) and 13(B) are sections showing an essential part of the reference example.
Figure 13B:
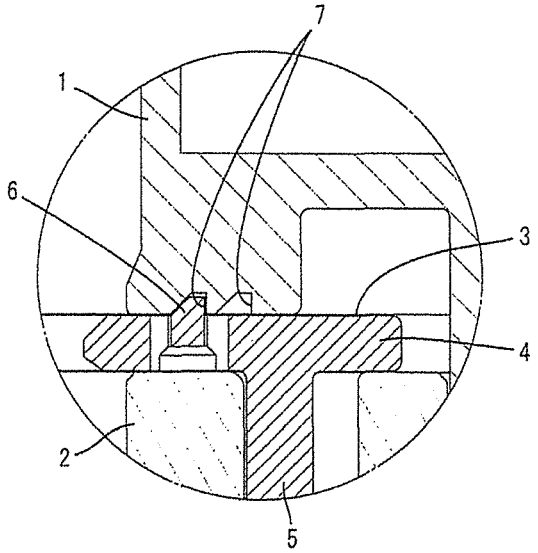
Prior Art FIG. 13(B)

The retainer 60 is made e.g. of synthetic resin and includes a wide rectangular plate shaped retainer main body 61 and two plate-shaped operating portions 62 projecting forward from opposite widthwise sides of the front surface of the retainer main body 61, as shown in FIG. 10. The retainer main body 61 is to be sandwiched between the first and second housings 10, 40 at the time of assembling. As shown in FIGS. 4 and 5, the retainer 60 is movable laterally in a moving direction MD between a partial locking position 1P and a full locking position 2P. In a moving process, the retainer main body 61 is slidable along the facing surfaces of the base 41 of the second housing 40 and the first housing 10. Note that, as shown in FIG. 7, the retainer main body 61 is constantly located inside the peripheral wall 46 and does not bulge out from the facing surfaces.

Through holes 63 penetrate through the retainer main body 61 at positions to communicate with the respective second cavities 44 when the retainer 60 is assembled with the second housing 40, as shown in FIG. 3. A retaining projection 64 projects in on each through hole 63 from a back side edge in a moving direction to the full locking position 2P.

The operating portions 62 are arranged on opposite widthwise sides of an upper part of the retainer main body 61, as shown in FIG. 10. Large through holes 63 are arranged in a widthwise intermediate area of the upper part of the retainer main body 61 and small through holes 63 are arranged in a lower part of the retainer main body 61.

Each operating portion 62 has a substantially rectangular cross-section extending in a height direction and includes a tip surface 65 that is exposed at the front surface of the first housing 10 when assembled.

Figure 2:
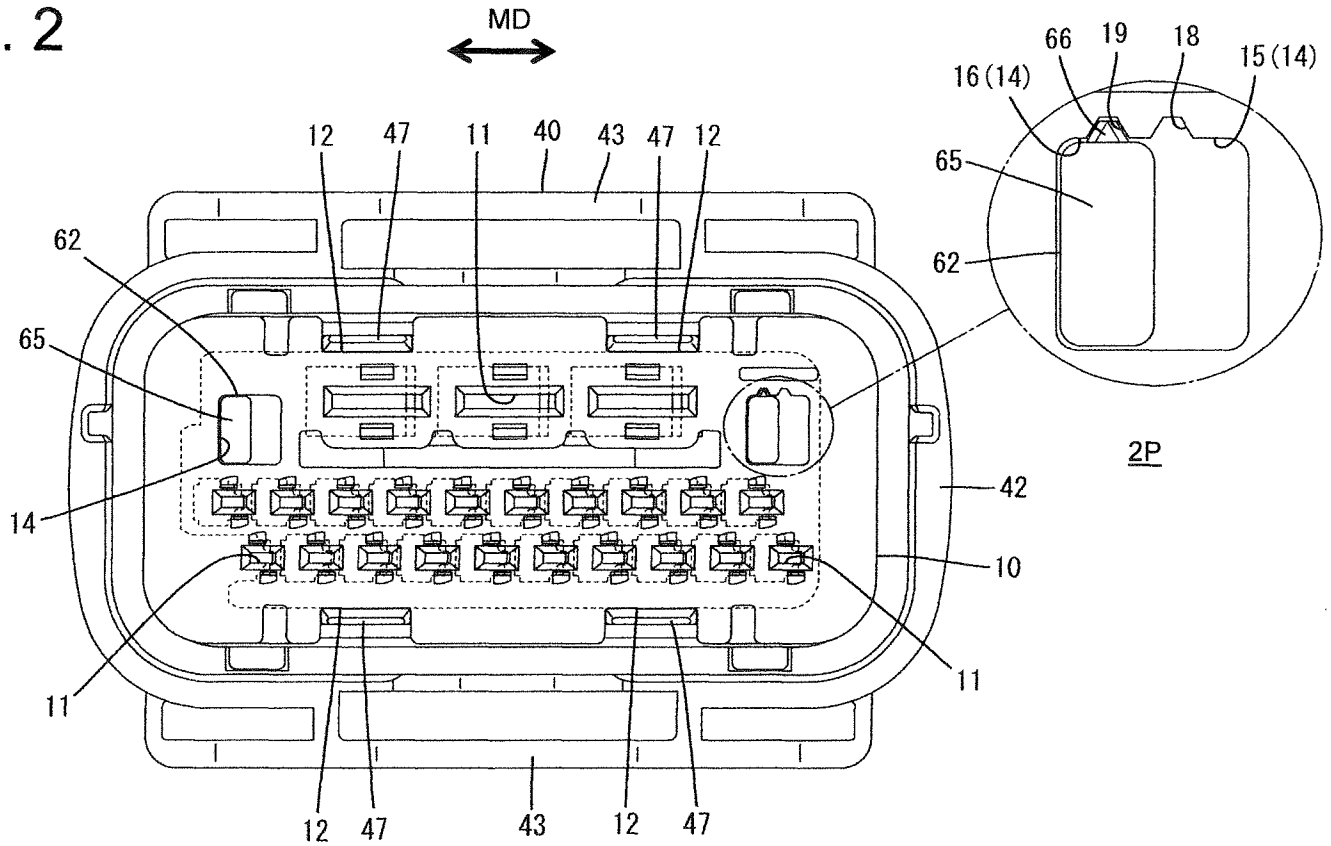
FIG. 2 is a front view showing a state where the retainer is at a full locking position.

As shown in FIG. 10, a long narrow locking rib 66 of trapezoidal cross-section is formed in a widthwise intermediate part of the upper surface of the operating portion 62 and extends in forward and backward directions from a position near the tip to a base end position coupled to the retainer main body 61. As shown in FIGS. 1 and 2, the locking rib 66 is capable of resiliently lock receiving grooves 18, 19 of the first housing 10 at the partial locking position 1P and the full locking position 2P.

Figure 9:
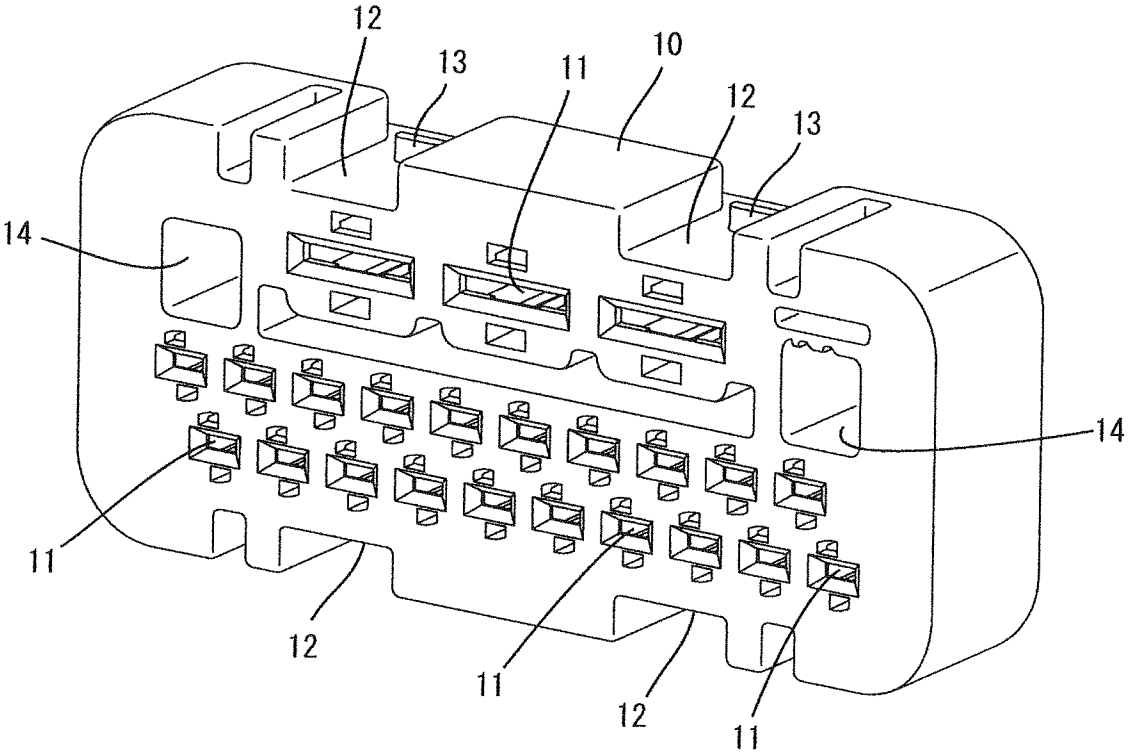
FIG. 9 is a perspective view of the first housing.

The first housing 10 is made e.g. of synthetic resin and defines a wide rectangular block, as shown in FIG. 9. First cavities 11 penetrate through the first housing 10 at positions that will communicate with the respective through holes 63. Thus, the first cavities 11, the through holes 63 and the second cavities 44 communicate substantially coaxially in forward and backward directions when the retainer 60 and the first housing 10 are assembled with the second housing 40, as shown in FIG. 4. The terminal fittings 100 connected to end portions of wires 110 are inserted into the respective first cavities 11 through the respective through holes 63 from the respective second cavities 44. Further, rubber plugs 120 mounted on the wires 110 are inserted into the respective second cavities 44 in a fluid-tight manner when the terminal fittings 100 are inserted properly into the first cavities 11, thereby sealing the interior of the connector.

The retaining projections 64 are retracted from insertion paths for the terminal fittings 100 in the through holes 63 if the retainer 60 is at the partial locking position 1P, as shown in FIG. 4, thereby permitting the terminal fittings 100 to be inserted into the first cavities 11. On the other hand, the retaining projections 64 are in the insertion paths for the terminal fittings 100 if the retainer 60 is at the full locking position 2P, as shown in FIG. 5. At this time, the retaining projections 64 lock the properly inserted terminal fittings 100 from behind to prevent the terminal fittings 100 from coming out of the first cavities 11.

Upper and lower surfaces of the first housing 10 are recessed to form two lock receiving portions 12 that are spaced apart in the width direction WD as shown in FIG. 9. Each lock receiving portion 12 is a groove having a substantially angular U-shaped cross-section extending in forward and backward directions and is open on both front and rear surfaces of the first housing 10. A lock projection 13 is formed on the bottom surface of each lock receiving portion 12 and extends in the width direction WD. When the retainer 60 and the first housing 10 are assembled with the second housing 40, the respective lock ribs 47 are fit in the respective lock receiving portions 12 across the retainer 60 (see FIGS. 1 and 8) and the lock holes 48 of the respective lock pieces 47 are fit resiliently to the respective lock projections 13, thereby coupling the first housing 10 to the second housing 40 while sandwiching the retainer 60 therebetween.

Two locking holes 14 penetrate opposite widthwise sides of an upper part of the first housing 10, as shown in FIG. 9. The locking holes 14 are substantially opposite widthwise sides of the respective large first cavities 11 and above the small first cavities 11 on substantially opposite widthwise ends of a lower part of the first housing 10, and are at positions corresponding to the operating portions 62 at the time of assembling.

Each locking hole 14 has a substantially square cross-section and is composed of a partial locking hole 15 located near a first widthwise side and a full locking hole 16 communicating with the partial locking hole 15 and located near the second widthwise side, as shown in FIG. 1. The operating portions 62 of the retainer 60 are arranged in the partial locking holes 15 at the partial locking position 1P, as shown in FIG. 1, and are arranged in the full locking holes 16 at the full locking position 2P, as shown in FIG. 2. Further, edges of the operating portions 62 on the second widthwise side are arranged in communicating areas of the partial locking holes 15 and the full locking holes 16 when the retainer 60 is at the partial locking position 1P, whereas edges of the operating portions 62 on the first widthwise side are arranged in communicating areas of the partial locking holes 15 and the full locking holes 16 when the retainer 60 is at the full locking position 2P are arranged. Furthermore, as shown in FIG. 1, clearances 17 are formed between the edges of the operating portions 62 at the first widthwise side and the side edges of the partial locking holes 15 at the full locking position 2P and an unillustrated jig is insertable into these clearances 17.

Further, as shown in FIG. 1, the two lock receiving portions 18, 19 are formed substantially side by side in the width direction WD on an edge of the locking hole 14 on the one widthwise side. Specifically, the lock receiving portions 18, 19 include a partial lock receiving portion 18 formed by recessing the upper edge of the partial locking hole 15 and a full lock receiving portion 19 formed by recessing the upper edge of the full locking hole 16. The partial and full lock receiving portions 18, 19 have substantially identical isosceles trapezoidal cross-sections substantially corresponding to the locking rib 66. Further, an area defined between the partial lock receiving portion 18 and the full lock receiving portion 19 on the upper edge of the locking hole 14 also has the same trapezoidal cross-section as the partial and full lock receiving portions 18, 19.

The locking rib 66 of the retainer 60 is fit resiliently into the partial lock receiving portion 18 from below at the partial locking position 1P, as shown in FIG. 1, and is fit resiliently into the full lock receiving portion 19 from below at the full locking position 2P, as shown in FIG. 2. Thus, the retainer 60 is to be held in a semi-locked state in the first housing 10 by the projection-recess engagement of the locking rib 66 and the lock receiving portion 18, 19 at the partial locking position 1P and the full locking position 2P.

The mating housing 90 is made e.g. of synthetic resin and includes the tubular receptacle 91. As shown in FIG. 4, tabs 201 of mating terminal fittings 200 project into the receptacle 91. When the mating housing 90 is connected properly to the connector, the receptacle 91 is fit into a clearance between the fitting tube 42 and the first housing 10.

Two laterally spaced protrusions 92 are formed inside the receptacle 91, as shown in FIG. 4. The protrusions 92 are plates projecting forward from the back wall of the receptacle 91 and are at positions facing the partial locking holes 15 in a state directly facing the connector. Each protrusion 92 has a substantially rectangular cross-section extending in the height direction and includes a tip surface 93 located before the tips of the respective tabs 201.

If the mating housing 90 is connected to the connector when the retainer 60 is at the full locking position 2P, as shown in FIG. 5, the operating portions 62 are retracted from the partial locking holes 15. Thus, the protrusions 92 are inserted into the partial locking holes 15 from the front. Further, if the mating housing 90 is connected to the connector when the retainer 60 is at the partial locking position 1P or at an intermediate position between the partial locking position 1P and the full locking position 2P, as shown in FIG. 4, the operating portions 62 remain in the partial locking holes 15 and the tips 93 of the protrusions 92 contact the tips 65 of the operating portions 62.

Figure 8:
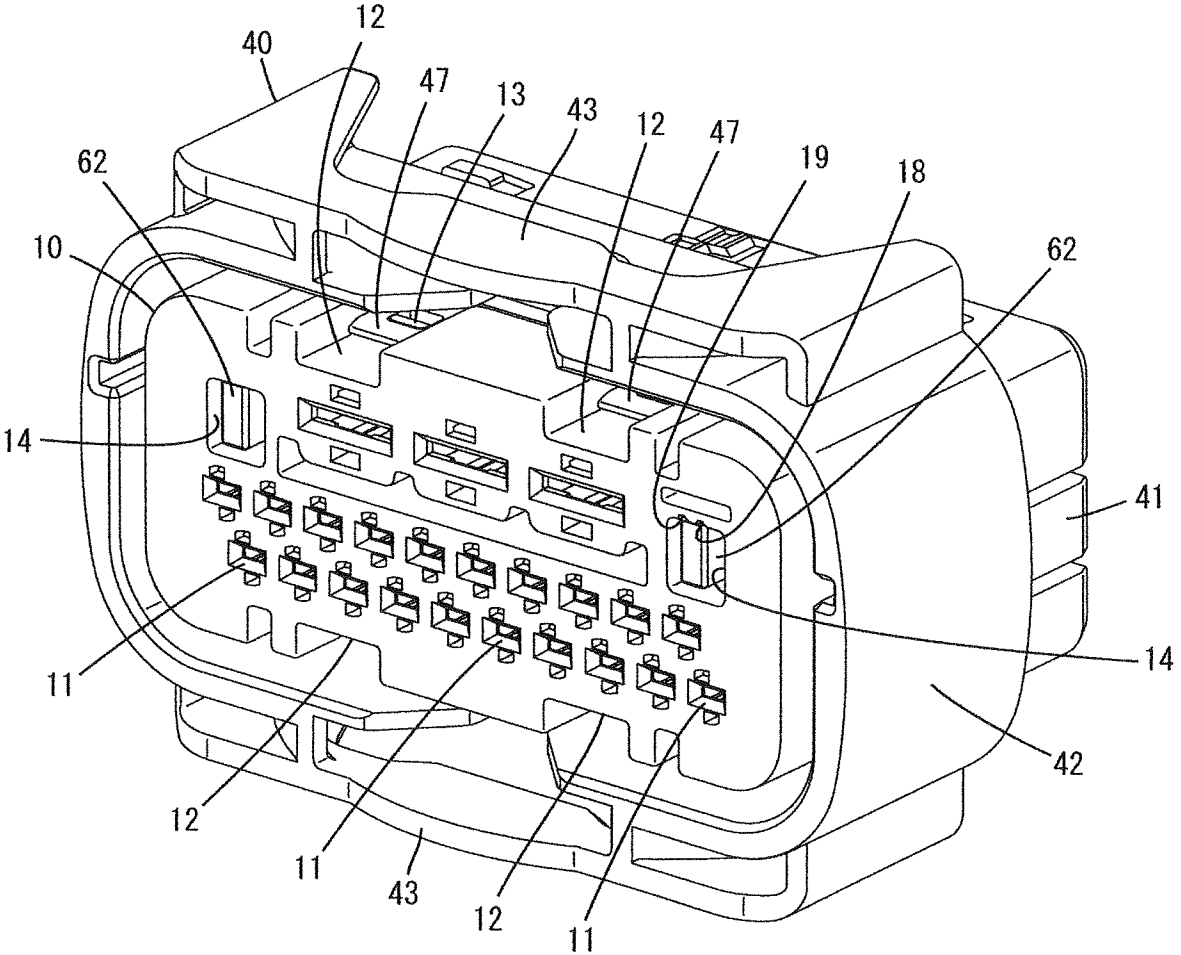
FIG. 8 is a perspective view showing a state where the retainer and a first housing are assembled with the second housing.

In assembling, the retainer 60 and the first housing 10 are inserted successively into the fitting tube 42 of the second housing 40 from the front, as shown in FIGS. 6 through 8. In this way, the retainer 60 is sandwiched between the base 41 of the second housing 40 and the first housing 10 (see FIG. 3). When the retainer 60 and the first housing 10 are assembled properly with the second housing 40, the respective lock pieces 47 resiliently lock the respective lock projections 13 to hold that assembled state.

The retainer 60 is kept at the partial locking position 1P by fitting the locking rib 66 into the partial locking hole 15 so that the tip surfaces 65 of the operating portions 62 are exposed at the front ends of the partial locking holes 15. In that state, the terminal fittings 100 with the respective wires 110 are inserted into the first cavities 11 of the first housing 10 from behind. The retainer 60 is moved to the full locking position 2P, as shown in FIGS. 1 through 2, after the terminal fittings 100 are inserted properly into the first cavities 11. In this case, the unillustrated jig particularly is inserted into the clearance 17 between the side edge of the partial locking hole 15 and the operating portion 62 and operated therein. Thus, the operating portion 62 is pushed toward the other widthwise side and the retainer 60 reaches the full locking position 2P. When the retainer 60 reaches the full locking position 2P, the operating portions 62 are inserted properly into the full locking holes 16, the locking ribs 66 fit resiliently into the full locking receiving portion 19 and the retaining portions 64 lock the terminal fittings 100. Note that, at the full locking position 2P, the operating portions 62 are held substantially in contact with the side edges of the full locking holes 16 in forward and backward directions as shown in FIG. 3.

Next, the connector is connected to the mating housing 90. In a connecting process, the protrusions 92 of the mating housing 90 slide on the side edges of the partial locking holes 15 and one widthwise edge of the operating portions 62, thereby guiding the connection of the mating housing 90. At the time of proper connection, the terminal fittings 100, 200 are connected to proper depths as shown in FIG. 5.

On the other hand, if the retainer 60 is left before reaching the full locking position 2P or the retainer 60 is not moved to the full locking position 2P at all, as shown in FIG. 4, the tips 93 of the protrusions 92 contact the tip surfaces 65 of both operating portions 62 during the connecting operation of the mating housing 90, thereby stopping the connecting operation of the mating housing 90. Thus, if the connecting operation of the mating housing 90 is stopped, and operator knows that the retainer 60 has not reached the full locking position 2P. In such a case, the retainer 60 is brought to the full locking position 2P and the connecting operation is or can be performed again.

As described above, according to this embodiment, a projecting direction of the locking rib 66 and a depth direction of the lock receiving portions 18, 19 are set substantially at the height direction (direction intersecting with forward and backward directions which are assembling directions of the first housing 10, the retainer 60 and the second housing 40), i.e. an engaging direction of the locking portion 66 and the lock receiving portions 18 19 is set at the direction intersecting the forward and backward directions. Thus, even if there is an assembling error in forward and backward directions between the first housing 10 and the retainer 60, an engagement margin between the locking rib 66 and the lock receiving portions 18, 19 is not affected. As a result, reliability in holding the retainer 60 onto the first housing 10 is enhanced.

Further, since the locking rib 66 is formed on the operating portion 62 of the retainer 60, an operating force applied to the operating portion 62 can be utilized directly as a force for releasing the locked state of the locking receiving portion 18, 19 by the locking portion 66 when the retainer 60 is moved, wherefore releasing operability is good.

Further, if the operating portions 62 are not located properly in the full locking positions 16, the protrusions 92 interfere with the operating portions 62, thereby stopping the connecting operation of the mating housing 90. Thus, a situation is avoided where the retainer 60 is left without reaching the full locking position 2P. Further, since the operating portions 62 are inserted into the partial locking holes 15 when the retainer 60 is at the partial locking position 1P, the protrusions 92 are inserted into the partial locking holes 15 when the retainer 60 is at the full locking position 2P and the partial locking holes 15 are shared by the protrusions 92 and the operating portions 62, the configuration of the first housing 10 can be simplified. In addition, since the protrusions 92 have a function of guiding the connecting operation of the mating housing 90 in addition to a function of detecting the position of the retainer 60, the configuration of the mating housing 90 is simplified as compared with the case where the both functions are provided separately.

The invention is not limited to the above described embodiment. For example, the following embodiments also are included in the scope of the invention.

The lock may be formed on each of the operating portions and the lock receiving portions may be formed on the hole edge of each of the locking holes.

The lock may be formed on the lower surface of the operating portion, the lock receiving portions may be formed on the lower edge of the locking hole and the lock may be fit into the lock receiving portions from above.

The lock may be formed on each of the upper and lower surfaces of the operating portion, the lock receiving portions may be formed on each of the upper and lower edges of the locking hole, and the locks may fit into the lock receiving portions both from below and from above.

The retainer may be movable in the height direction between the partial locking position and the full locking position and the locks and the lock receiving portions may be engaged in the width direction.

Contrary to the above embodiment, the lock may be in the form of a recess and the lock receiving portions may be in the form of projections.

The lock receiving portions may be in the form of one or more projections similar to the lock and the lock may be engaged with a valley defining the projections.

The retainer may include one, three or more operating portions. Further, the mating housing may include one, three or more protrusions.

What is claimed is:

1. A connector, comprising:

a first housing into which at least one terminal fitting is insertable, the first housing being formed with at least one lock receiving portion;

a retainer configured for locking and retaining the terminal fitting properly inserted into the first housing, the retainer including at least one operating portion projecting forward so that a portion thereof is exposed at a front of the first housing and the retainer being movable by an operating force applied to the operating portion from the front of the first housing, the operating portion being formed with at least one lock, and the lock resiliently engageable with the locking receiving portion; and a second housing having a base and a fitting tube projecting forward from the base and configured for receiving the retainer and the first housing successively in an assembly direction, wherein the retainer is slidable along the base in directions transverse to the assembly direction between a first position in which the at least one terminal fitting is insertable into the first housing and a second position in which the at least one terminal fitting is retained in the first housing.

2. The connector of claim 1, wherein the first housing is formed with at least one lock receiving portion comprises two lock receiving portions arranged substantially side by side in a moving direction of the retainer, and wherein the lock (66) resiliently locks the locking receiving portion to keep the retainer at the first position and the second position.

3. The connector of claim 2, wherein the first housing is formed with a first hole for receiving the operating portion at the first position and a second hole for receiving the operating portion at the second position.

4. The connector of claim 3, wherein the first and second locking holes communicate in the moving direction of the retainer.

5. The connector of claim 3, wherein a protrusion of a mating housing is inserted into the first hole to permit a connection operation to the mating housing when the operating portion is located properly in the second hole, and the protrusion interfering with a tip of the operating portion to stop the connecting operation to the mating housing when the operating portion is not properly located in the second hole.

6. The connector of claim 5, wherein the protrusion is slidable on an inner surface of the first hole and a side surface of the operating portion in the process of connection to the mating housing when the operating portion is located properly in the second hole.

7. The connector of claim 5, wherein the protrusion is to be arranged at each of a plurality of spaced-apart positions of the mating housing.

8. The connector of claim 1, wherein the operating portion is arranged at each of a plurality of spaced-apart positions of the retainer.

9. The connector of claim 1, wherein at least one jig insertion clearance is formed between an edge of the operating portion and a side edge of the first hole at the second position.

10. A connector, comprising:

a first housing into which at least one terminal fitting is insertable in an inserting direction, the first housing being formed with first and second lock receiving portions arranged side by side in a moving direction transverse to the inserting direction;

a retainer configured for locking and retaining the terminal fitting properly inserted into the first housing, the retainer including at least one operating portion projecting forward so that a portion thereof is exposed at a front of the first housing and the retainer being movable by an operating force applied to the operating portion from the front of the first housing, the operating portion being formed with at least one lock configured to selectively engage the first and second lock receiving portions; and a second housing having a base and a fitting tube projecting forward from the base and configured for receiving the retainer and the first housing successively in an assembly direction, wherein the retainer is movable in the moving direction between a partial locking position in which the at least one lock engages the first lock receiving portion and the at least one terminal fitting is insertable into the first housing and a full locking position in which the at least one lock engages the second lock receiving portion and the terminal fitting is retained in the first housing.

11. The connector of claim 10, wherein the first housing is formed with a first hole for receiving the operating portion at the partial locking position and a second hole for receiving the operating portion at the full locking position.

12. The connector of claim 11, wherein the first and second locking holes communicate in the moving direction of the retainer.

13. The connector of claim 11, wherein a protrusion of a mating housing is inserted into the first hole to permit a connection operation to the mating housing when the operating portion is located properly in the second hole, and the protrusion interfering with a tip of the operating portion to stop the connecting operation to the mating housing when the operating portion is not properly located in the second hole.

14. The connector of claim 13, wherein the protrusion is slidable on an inner surface of the first hole and a side surface of the operating portion in the process of connection to the mating housing when the operating portion is located properly in the second hole.

15. The connector of claim 13, wherein the protrusion is to be arranged at each of a plurality of spaced-apart positions of the mating housing.

16. The connector of claim 10, wherein the operating portion is arranged at each of a plurality of spaced-apart positions of the retainer.

17. The connector of claim 10, wherein at least one jig insertion clearance is formed between an edge of the operating portion and a side edge of the first hole at the full locking position.

18. The connector of claim 10, wherein the moving direction is transverse to the assembly direction.

* * * * *